US011505989B1

(12) United States Patent
Chiang et al.

(10) Patent No.: US 11,505,989 B1
(45) Date of Patent: Nov. 22, 2022

(54) CORD WINDING ASSEMBLY WITH FINE ADJUSTMENT AND CORRECTION AND WINDOW BLIND USING SAME

(71) Applicant: CHING FENG HOME FASHIONS CO., LTD., Fuxing Township, Changhua County (TW)

(72) Inventors: Ming-Chu Chiang, Fuxing Township (TW); Yu-Ping Chou, Fuxing Township (TW)

(73) Assignee: CHING FENG HOME FASHIONS CO., LTD., Fuxing Township, Changhua County (TW)

( * ) Notice: Subject to any disclaimer, the term of this patent is extended or adjusted under 35 U.S.C. 154(b) by 0 days.

(21) Appl. No.: 17/528,795

(22) Filed: Nov. 17, 2021

Related U.S. Application Data

(60) Provisional application No. 63/220,678, filed on Jul. 12, 2021.

(30) Foreign Application Priority Data

Oct. 1, 2021 (TW) ..... 110136726

(51) Int. Cl.

| | |
|---|---|
| ***E06B 9/38*** | (2006.01) |
| ***E06B 9/262*** | (2006.01) |
| *E06B 9/382* | (2006.01) |

(52) U.S. Cl.
CPC ..... *E06B 9/38* (2013.01); *E06B 9/262* (2013.01); *E06B 9/382* (2013.01); *E06B 2009/2627* (2013.01)

(58) Field of Classification Search
CPC . E06B 9/38; E06B 9/262; E06B 9/382; E06B 2009/2627; E06B 2009/3222
See application file for complete search history.

(56) References Cited

FOREIGN PATENT DOCUMENTS

| | | |
|---|---|---|
| JP | 3151217 U | 6/2009 |
| TW | 201932703 A | 8/2019 |
| TW | M593459 U | 4/2020 |

*Primary Examiner* — Johnnie A. Shablack
(74) *Attorney, Agent, or Firm* — Birch, Stewart, Kolasch & Birch, LLP

(57) ABSTRACT

A window blind includes a headrail, two lift cords, a blind body, a bottom rail, and two cord winding assemblies that are respectively installed on two opposite sides of the long axis of the bottom rail. The other ends of the lift cords are respectively tied to respective adjustment columns of the cord winding assemblies. When the window blind is folded or stretched, unfortunately, when the winding stroke is inconsistent, the blind body is not folded uniformly or skewed, and the adjustment column of the cord winding assembly on one side can be finely adjusted, so that one of the lift cords is gradually wound and covered on the adjustment column, and indirectly drives the bottom rail and the blind body to gradually adjust to substantially parallel to the bottom of the headrail, thereby effectively achieving the effect of fine-tuning and correcting the blind body.

7 Claims, 18 Drawing Sheets

CORD WINDING ASSEMBLY WITH FINE ADJUSTMENT AND CORRECTION AND WINDOW BLIND USING SAME

BACKGROUND OF THE INVENTION

1. Field of the Invention

The present invention relates to window blind winding technology, and in particular refers to a cord winding assembly with fine adjustment and correction, and a window blind using the cord winding assembly.

2. Description of the Related Art

Please refer to FIG. 1 first, it is a commonly known window blind 1 (for example: honeycomb blind or organ curtain), which comprises a headrail 91, two lift cords 92, a blind body 93 and a bottom rail 94. One side of the blind body 93 is installed on the bottom of the headrail 91, and the other side of the blind body 93 is installed on the top of the bottom rail 94. One ends of the two lift cords 92 are tied to the headrail 91 and are driven by the winding device in the headrail 91 to rotate clockwise or counterclockwise. The other ends of the two lift cords 92 are respectively penetrated with the headrail 91, the blind body 93 and the bottom rail 94. The other ends of the two lift cords 92 are respectively tied to a lock piece 95 at the bottom of the bottom rail 94. In this way, the blind body 93 of the window blind 1 can be driven by the two lift cords 92 by the winding device in the headrail 91 to rotate clockwise or counterclockwise, thereby allowing the blind body 93 gradually achieve the effect of folding or stretching.

However, the window blind 1 disclosed above still needs improvement, i.e., since the rope length of the two lift cords 92 from the headrail 91 to the bottom rail 94 has a predetermined stroke design, if the two lift cords 92 unfortunately have inconsistent winding strokes during winding, it will indirectly cause the blind body 93 and the bottom rail 94 to appear uneven or skewed, which is really inconvenient for users.

SUMMARY OF THE INVENTION

In order to solve the problems mentioned in the prior art, the present invention provides a window blind (for example: honeycomb blind or organ curtain), which comprises two cord winding assemblies, which are used to improve the uneven or skewed blind body when the window blind unfortunately experiences inconsistent winding strokes when the window blind is folded or stretched.

The window blind provided by the present invention comprises a headrail, two lift cords, a blind body, a bottom rail, and two cord winding assemblies that are respectively installed on two opposite sides of the long axis of the bottom rail. Each cord winding assembly comprises a plate-shaped body and an adjustment column.

The plate-shaped body comprises an outer portion), an inner portion opposite to the outer portion, and an adjustment hole penetrating the outer portion and the inner portion. The inner portion protrudes to form a fixed portion. The fixed portion has a perforation cut therethrough. The adjustment column comprises a small diameter end and a large diameter end. The end of the small diameter end of the adjustment column is recessed in the direction of the large diameter end to form a recess. The adjustment column is pivoted to the adjustment hole of the plate-shaped body. The recessed direction of the recess is intersected with the opening direction of the perforation of the fixed portion. The blind body has one side thereof set at the bottom of the headrail, and an opposite side thereof set at the top of the bottom rail. The two lift cords have respective one ends thereof respectively tied to a winding device provided in said headrail after a predetermined stroke, and respective opposite ends thereof passed through a respective threading member provided in the headrail, the blind body and the bottom rail and then respectively tied to said adjustment columns of the cord winding assemblies.

In summary, in this way, the two lift cords are driven by the winding device of the headrail to be rolled or stretched. with the technical feature that the other ends of the two lift cords are respectively tied to the adjustment columns of the two cord winding assemblies, you can select and fine-tune the adjustment column of the cord winding assembly on one side, so that one of the lift cords is gradually wound and covered on the respective adjustment column and indirectly drives the bottom rail and the blind body to gradually adjust until they are substantially parallel to the bottom of the headrail. This effectively achieves the effect of fine-tuning and correcting the blind body.

DETAILED DESCRIPTION OF THE INVENTION

The applicant first explains here that throughout the specification, including the following preferred embodiment and claims in the scope of the patent application, the nouns related to directionality are based on the directions of the diagrams listed in the "BRIEF DESCRIPTION OF THE DRAWINGS". Secondly, in the preferred embodiment and drawings to be introduced below, the same element numbers represent the same or similar elements or their structural features. Moreover, the detailed structure, characteristics, assembly or use, manufacturing and other methods of the present invention will be described in the detailed description of the subsequent preferred embodiment. However, those with ordinary knowledge in the field of the present invention should be able to understand that this detailed description and the examples listed in the present invention are only used to support the explanation that the present invention can be implemented based on it, and are not intended to limit the scope of patent application of the present invention.

Figure 1:
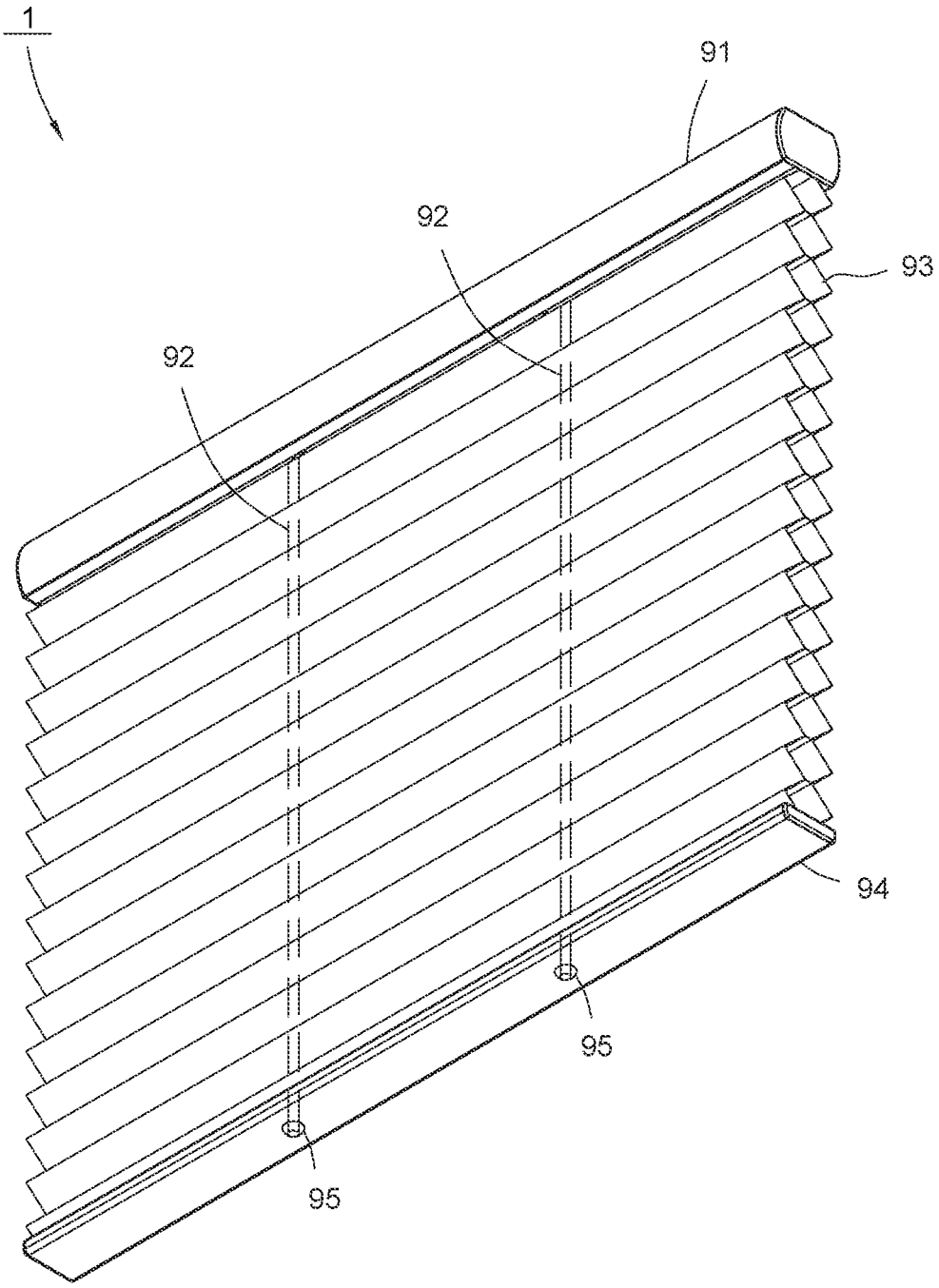
FIG. 1 PRIOR ART
FIG. 1 is a three-dimensional schematic diagram of a prior art window blind.
Figure 2:
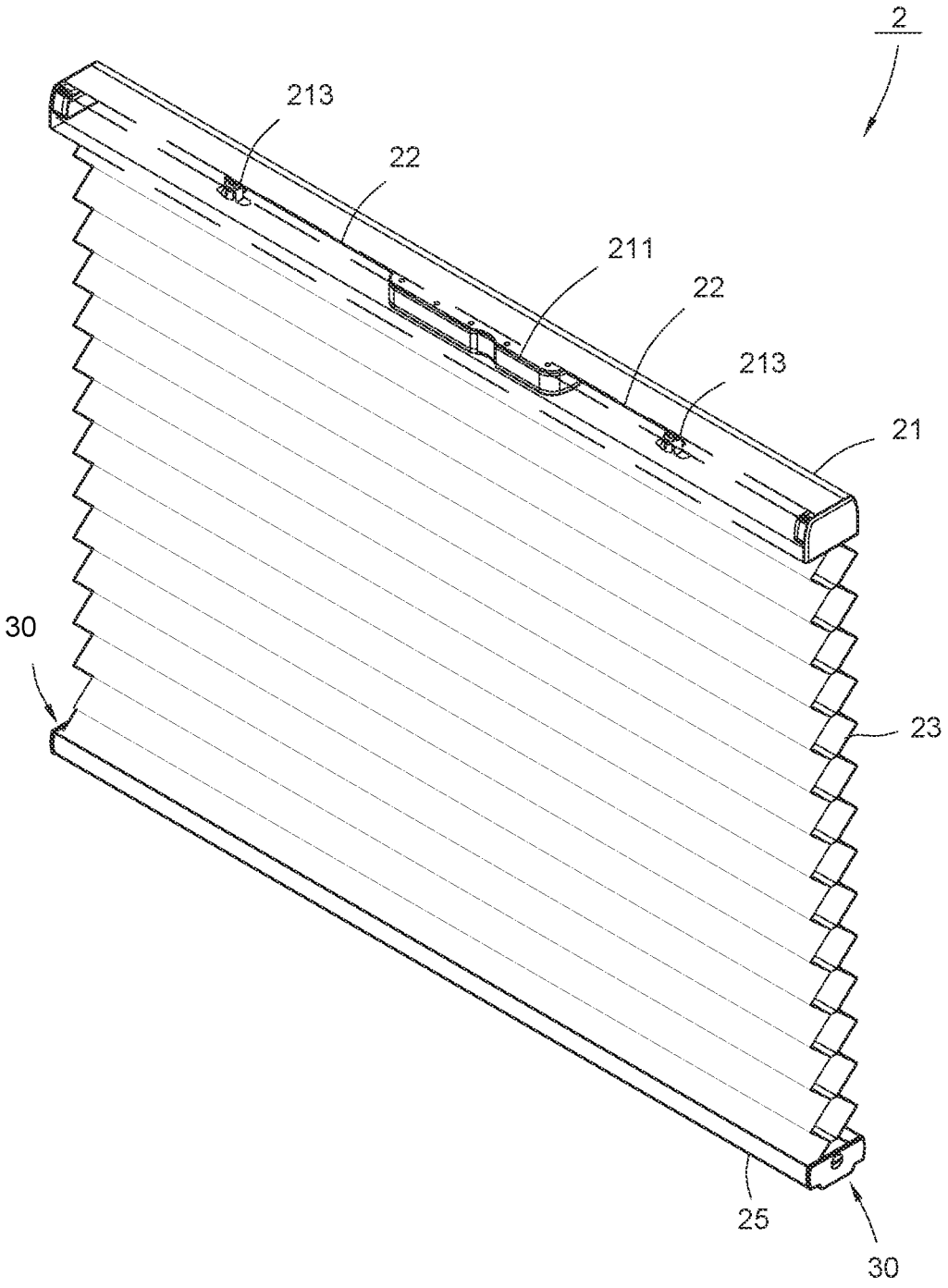
FIG. 2 is a three-dimensional schematic diagram of a preferred embodiment of the present invention, which mainly reveals that a window blind presents a smoothly expanded state.
Figure 3:
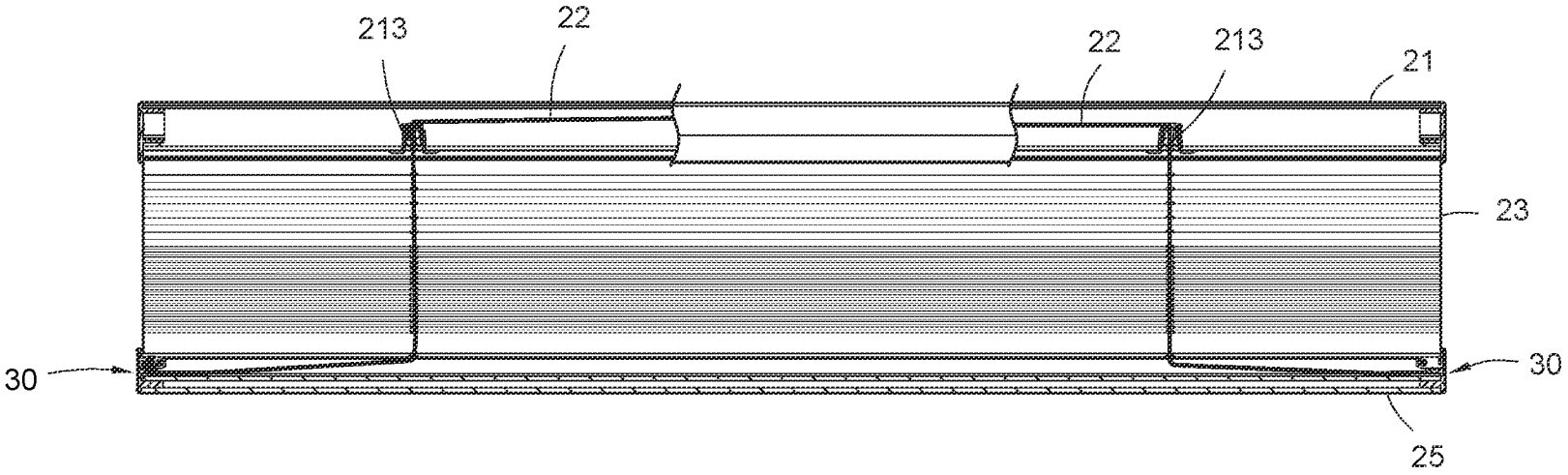
FIG. 3 is a schematic cross-sectional view of part of the components of FIG. 2, which mainly reveals that the window blind is in a smoothly folded state.
Figure 4:
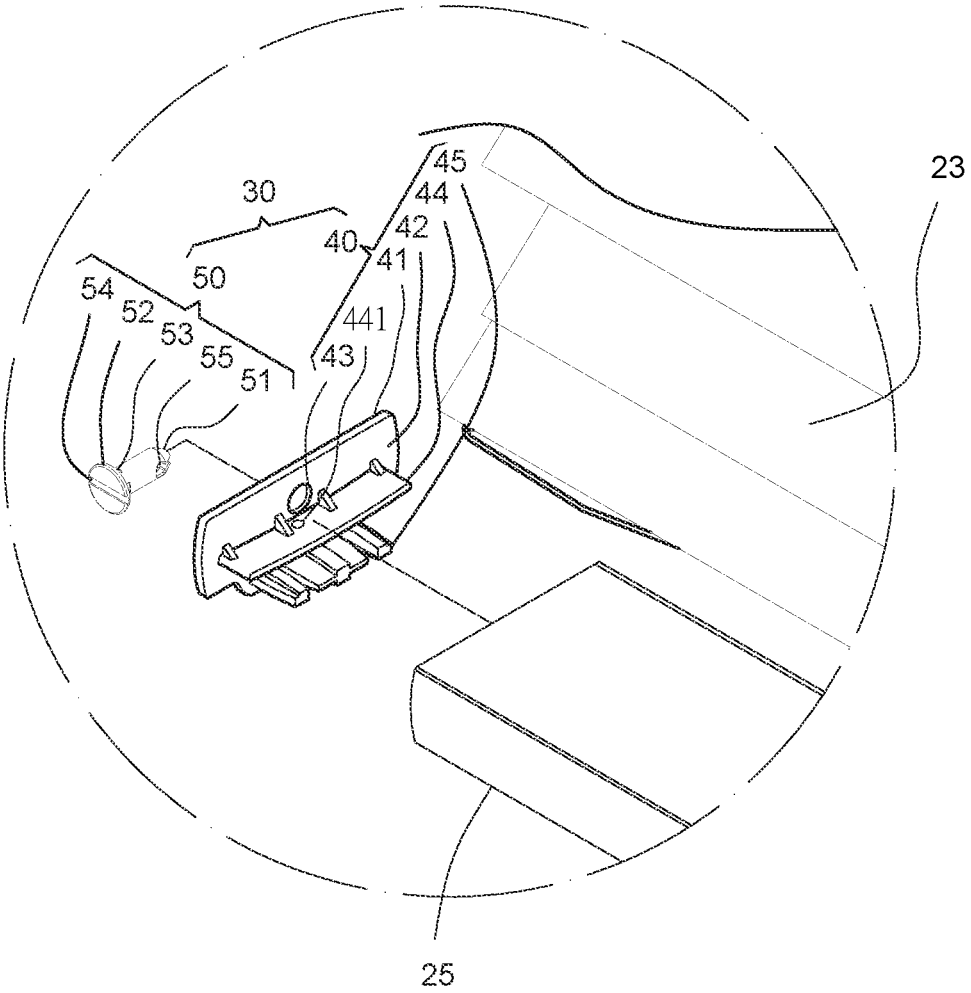
FIG. 4 is an exploded and enlarged schematic diagram of part of the components of FIG. 2, which mainly reveals the connection relationship between one cord winding assembly and a bottom rail of the window blind.
Figure 5:
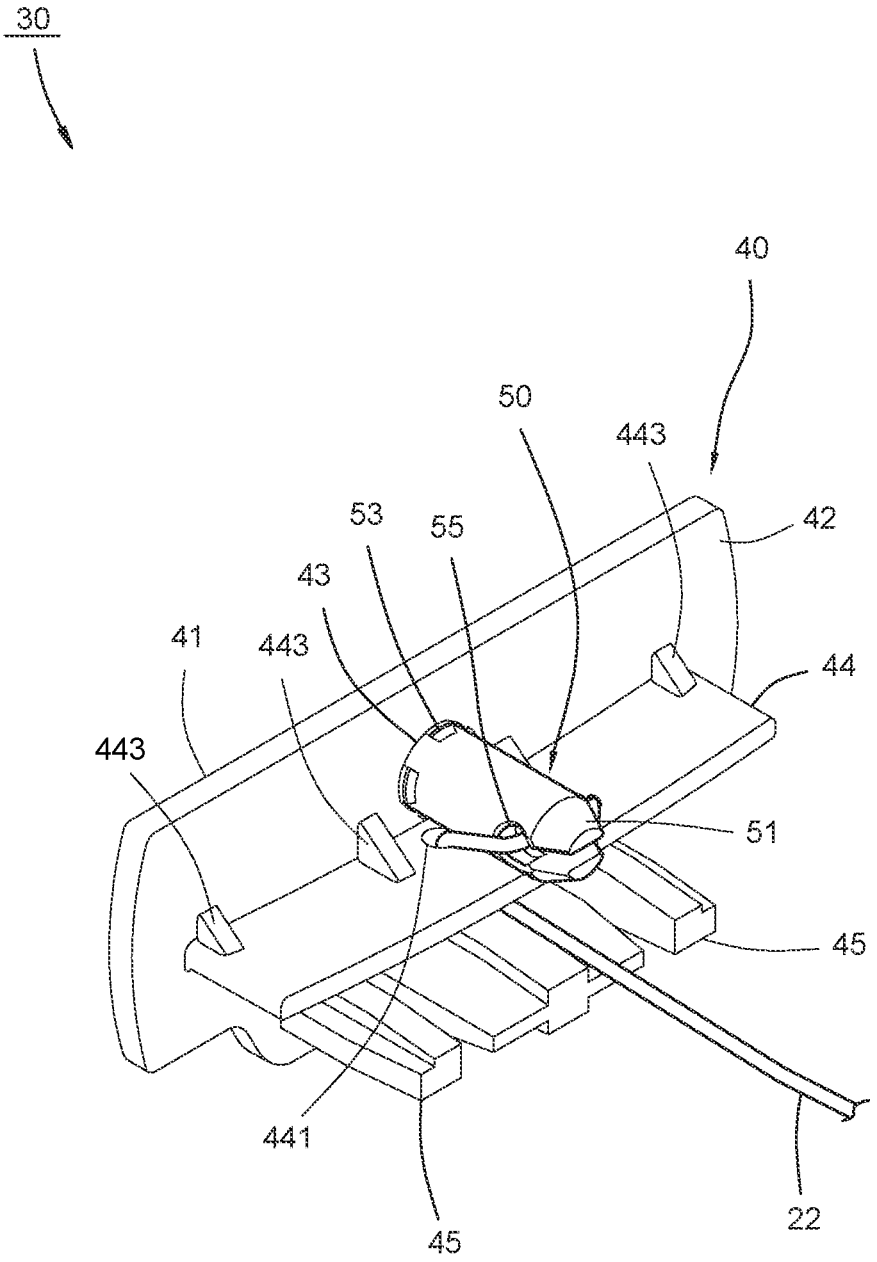
FIG. 5 is an enlarged schematic diagram of part of the components of FIG. 2, which mainly reveals the connection relationship between one cord winding assembly and a lift cord of the window blind.
Figure 6:
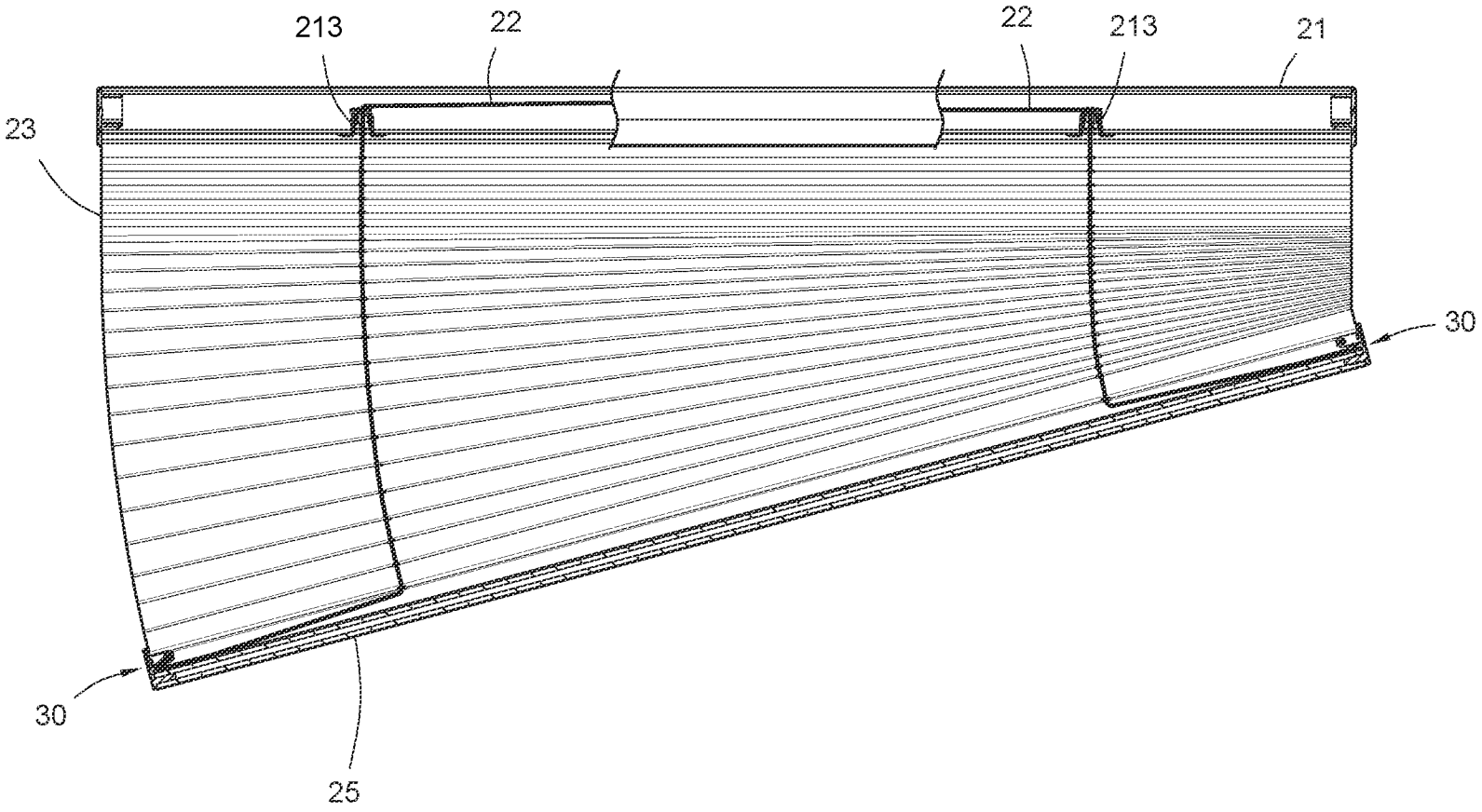
FIG. 6 is a schematic cross-sectional view of some components similar to FIG. 3, which mainly reveals that the window blind is in an unevenly folded state.
Figure 7:
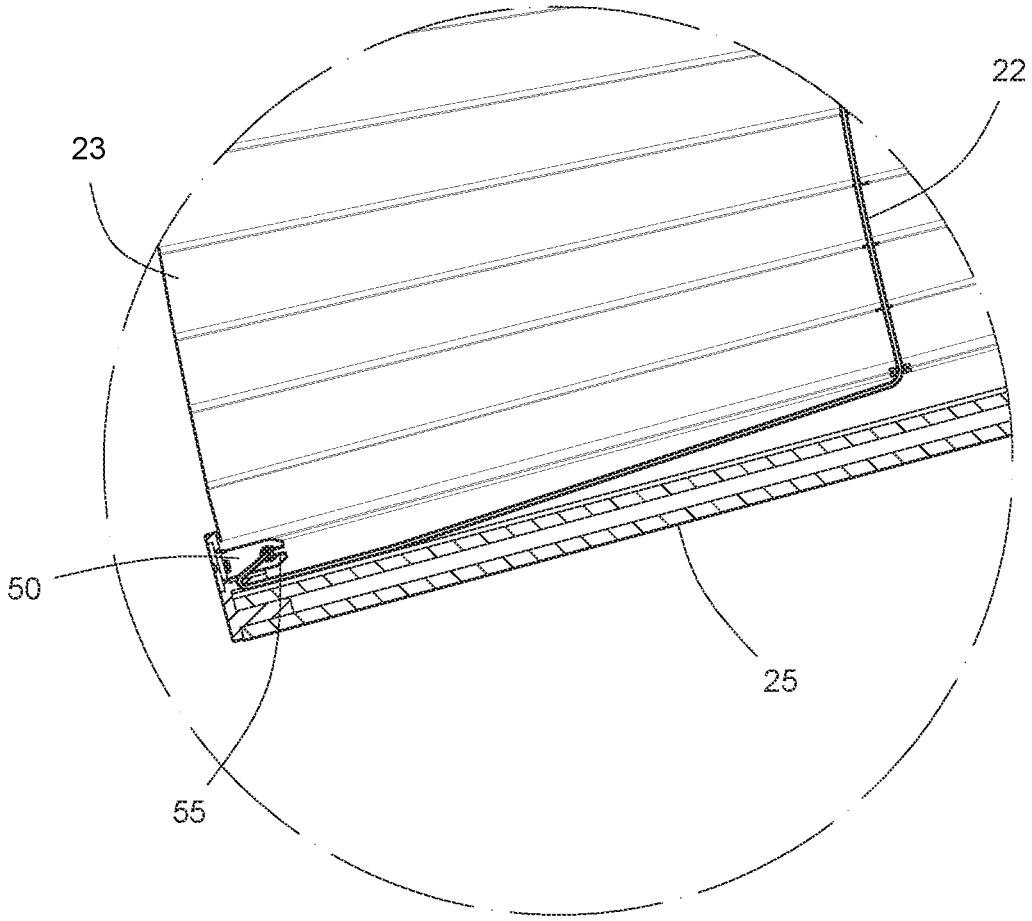
FIG. 7 is an enlarged schematic diagram of part of the components of FIG. 6, which mainly reveals the connection relationship between one cord winding assembly and the lift cord of the window blind that has not been fine-tuned.
Figure 8:
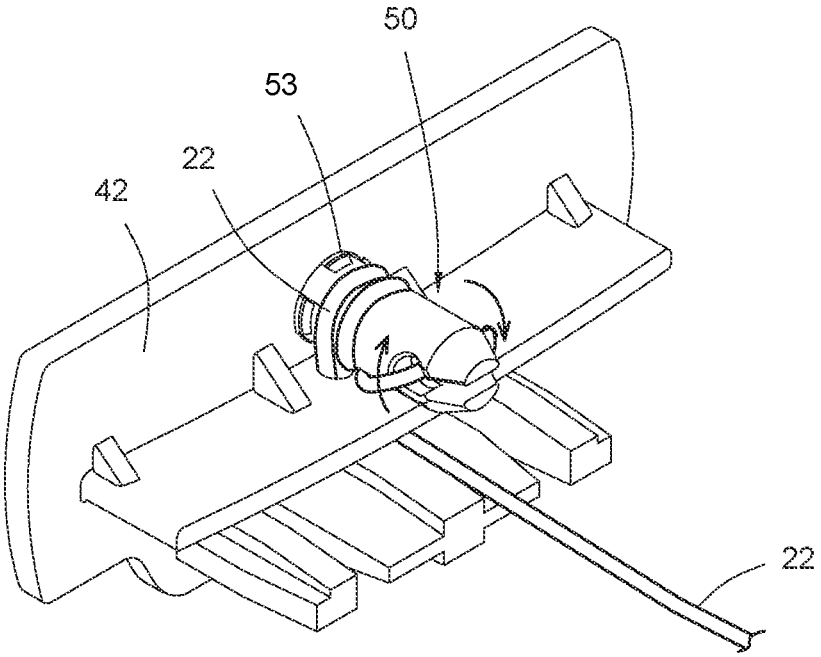
FIG. 8 is an enlarged schematic diagram of part of the components of FIG. 6, which mainly reveals the connection relationship between one cord winding assembly and the corresponding lift cord of the window blind being fine-tuned.

Please refer to FIGS. 2 and 3, which is a window blind 2 (for example, a honeycomb blind, or an organ curtain) disclosed in a preferred embodiment of the present invention, which comprises a headrail 21, two lift cords 22, and a blind body 23, a bottom rail 25 and two cord winding assemblies 30 installed on opposite sides of the longitudinal axis of the bottom rail 25. One side of the blind body 23 is installed on the bottom of the headrail 21, and the other side of the blind body 23 is installed on the top of the bottom rail 25. One ends of the two lift cords 22 are respectively tied to a winding device 211 provided in the headrail 21 through a predetermined stroke, so that the two lift cords 22 are driven by the winding device 211 to perform winding or unwinding. The other ends of the two lift cords 22 are respectively threaded through the two threading members 213 provided in the headrail 21, the blind body 23 and the bottom rail 25, and then tied to the two cord winding assemblies 30 on opposite sides of the long axis of the bottom rail 25.

Please refer to FIGS. 2 to 5 together. Any of the cord winding assemblies 30 comprises a plate-shaped body 40 and an adjustment column 50 pivoted on the plate-shaped body 40. The plate-shaped body 40 comprises an outer portion 41 and an inner portion 42 opposite to the outer portion 41, and an adjustment hole 43 is formed through the outer portion 41 toward the inner portion 42. The inner portion 42 protrudes to form a plate-shaped fixed portion 44, which is located at the lower edge of the adjustment hole 43. The fixed portion 44 is provided with a perforation 441 so that the opening direction of the perforation 441 of the fixed portion 44 and the opening direction of the adjustment hole 43 are intersected. Preferably, there are a plurality of reinforcing ribs 443 arranged at intervals between the inner portion 42 and the fixed portion 44, and the reinforcing ribs 443 are located on the side close to the adjustment hole 43. The inner portion 42 is protruding to form a plurality of locking ribs 45 arranged at intervals for locking on the bottom rail 25, and the fixed portion 44 is interposed between the reinforcing ribs 443 and the locking ribs 45. The adjustment column 50 has a small diameter end 51, a large diameter end 52 and a plurality of stop ribs 53. The end of the large diameter end 52 of the adjustment column 50 is recessed to form an adjustment slot 54. The end of the small diameter end 51 of the adjustment column 50 is recessed in the direction of the large diameter end 52 to form a recess 55. Preferably, the recessed direction of the recess 55 is in the same direction as the opening direction of the adjustment hole 43 and is intersected with the opening direction of the perforation 441 of the fixed portion 44. The plural stop ribs 53 of the adjustment column 50 radially surround the outer peripheral wall of the adjustment column 50 at intervals, and the stop ribs 53 are closer to the large diameter end 52, so that the predetermined distance between the large diameter end 52 and the stop ribs 53 is exactly greater than or equal to the overall thickness of the plate-shaped body 40.

The above are the technical features of a window blind 2 (for example, a honeycomb blind, or an organ curtain) and its respective components disclosed in the preferred embodiment of the present invention. Please refer to FIGS. 2 to 5 together, and we will continue to disclose how the two cord winding assemblies 30 installed on opposite sides of the long axis of the bottom rail 25 of the window blind 2 cooperate with the operation mode of the overall window blind 2 and the desired effect:

First, the two cord winding assemblies 30 are installed on the opposite sides of the long axis of the bottom rail 25 and arranged opposite each other, so that the locking ribs 45 of the plate-shaped bodies 40 of the two cord winding assemblies 30 are stuck at the bottom of the bottom rail 25. In this way, with the technical features that the locking ribs 45 of the plate-shaped bodies 40 of the cord winding assemblies 30 are clamped on the bottom rail 25, any cord winding assembly 30 reaches the effect of no longer being easily disconnected from the bottom rail 25 of the window blind 2. Secondly, please refer to FIG. 4 and FIG. 5. The small diameter ends 51 of the adjustment columns 50 of the two cord winding assemblies 30 and the plurality of stop ribs 53 are respectively pierced through the adjustment holes 43 of the two plate-shaped bodies 40 to make the large diameter ends 52 of the two adjustment columns 50 are respectively blocked in the outer portions 41 of the two plate-shaped bodies 40. At this time, the plural stop ribs 53 of any adjustment column 50 are also blocked on the inner portion 42 of the plate-shaped body 40 after passing through the adjustment hole 43 of the plate-shaped body 40, so that the two adjustment columns 50 can be movably and respectively pivoted at the adjustment holes 43 of the two plate-shaped bodies 40. In this way, with the technical feature that the large diameter end 52 and the plural stop ribs 53 of the adjustment column 50 of any cord winding assembly 30 are respectively stopped at the outer portion 41 and the inner portion 42 of the plate-shaped body 40, the adjustment column 50 is no longer easily disconnected from the respective cord winding assembly 30.

Furthermore, please refer to FIGS. 2 to 5 together. Let the other ends of the second lift cords 22 of the window blind 2 pass through the threading members 213 provided in the headrail 21, the blind body 23 and the bottom rail 25, and then pass through the perforations 441 of the plate-shaped bodies 40 of the two cord winding assemblies 30 separately, and then respectively pass through the recesses 55 of the small diameter ends 51 of the adjustment columns 50, and then tie them and fix them. In this way, with the technical characteristics that the opening direction of the perforation 441 of the fixed portion 44 of any plate-shaped body 40 is intersected with the opening direction of the respective adjustment hole 43, and the recess 55 of the small diameter end 51 of the respective adjustment column 50, the other end of the lift cord 22 can pass through the perforation 441 of the fixed portion 44 of the plate-shaped body 40 and then be fixed at the recess 55 of the small diameter end 51 of the adjustment column 50, so that the other end of the lift cord 22 will be no longer easily separated from the adjustment column 50 of the cord winding assembly 30. It can further enable the cord winding assembly 30 adjustment column 50 and the winding device 211 of the headrail 21 to cleverly achieve the effect of mutual restraint through the two ends of the lift cord 22.

Finally, please refer to FIGS. 2 to 8 together. If, unfortunately, when the two lift cords 22 of the window blind 2 are folded or stretched, the winding strokes of the two lift cords 22 are inconsistent, which indirectly causes the indirectly cause the two components of the blind body 23 and the bottom rail 25 to no longer be roughly parallel based on the bottom of the headrail 21, which results in uneven or skewed folding of the blind body 23, at this time, with the technical characteristics that the other ends of the two lift cords 22 are respectively tied to the adjustment columns 50 of the two cord winding assemblies 30, depending on the situation, you can select and fine-tune the adjustment column 50 of the cord winding assembly 30 on one side, so that one of the lift cords 22 is gradually wound and covered on the respective adjustment column 50 and indirectly drives the bottom rail 25 and the blind body 23 to gradually adjust until they are substantially parallel to the bottom of the headrail 21, so that the blind body 23 and the bottom rail 25 can again resume smooth folding or stretching. In this way, it will be able to effectively achieve the blind body 23 fine-tuning, correcting and resetting. It is worth mentioning that an external hand tool can be inserted into the adjustment slot 54 of the adjustment column 50 of the cord winding assembly 30 to facilitate the application of clockwise or counterclockwise force to make the adjustment column 50 easier to pivot.

Figure 9:
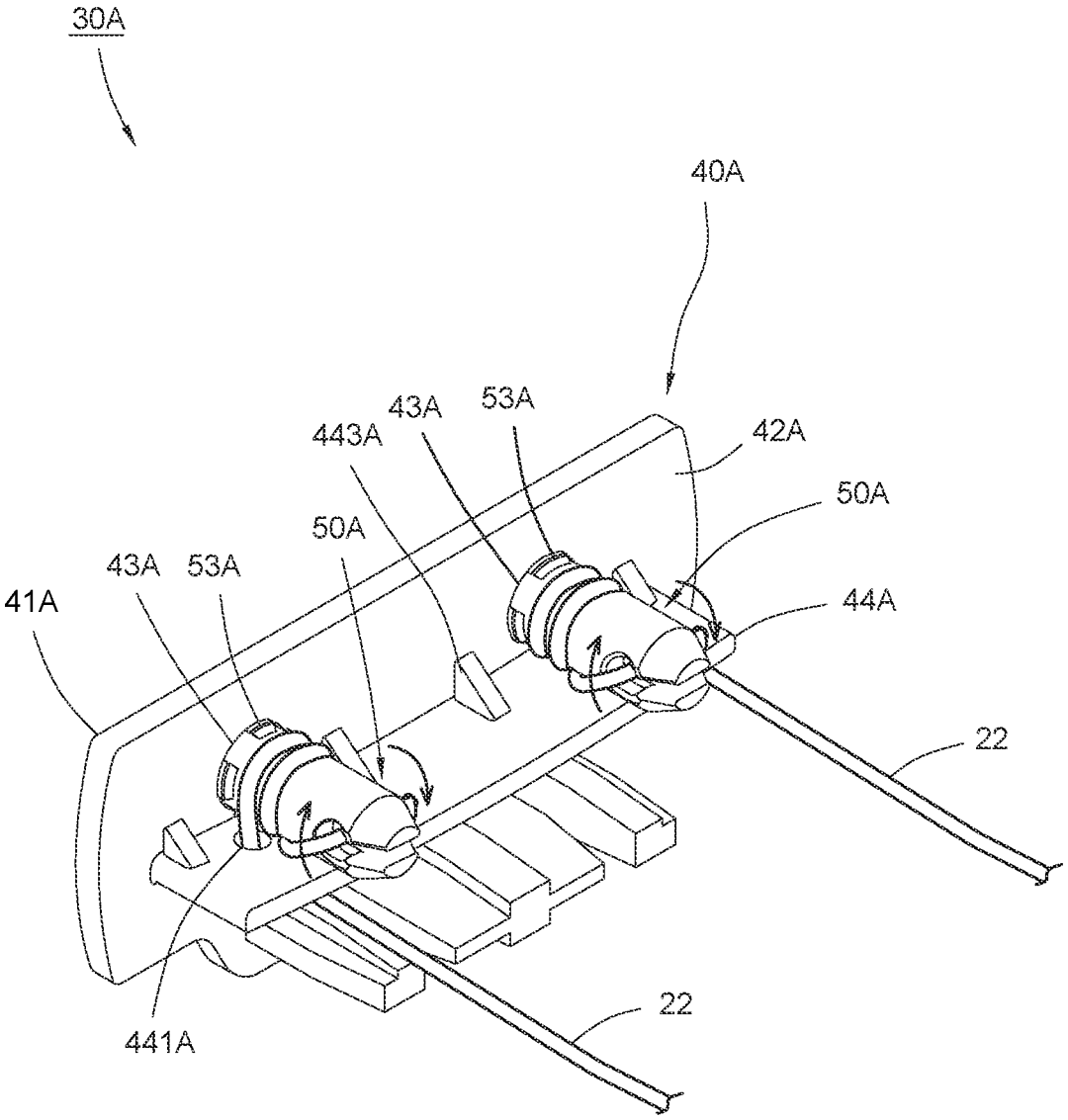
FIG. 9 is another cord winding assembly suitable for the window blind disclosed in the preferred embodiment of the present invention, which mainly reveals the connection relationship between an alternate form of cord winding assembly and the corresponding lift cord that is being fine-tuned.

Please refer to FIG. 2 and FIG. 9, which provides another cord winding assembly 30A suitable for the window blind 2. Its main structure and technical characteristics are the same as the previous preferred embodiment. The differences between this cord winding assembly 30A the cord winding assembly 30 in previous preferred embodiment are outlined hereinafter. Two adjustment holes 43A are formed through the outer portion 41A of the plate-shaped body 40A of the cord winding assembly 30A toward the inner portion 42A, and the inner portion 42A protrudes to form a fixed portion 44A that is located at the lower edge of the adjustment holes 43A. The fixed portion 44A matches the positions of the two adjustment holes 43A to form two perforations 441A. Similarly, make the opening direction of the two perforations 441A of the fixed portion 44A cross the opening direction of the two adjustment holes 43A. Between the inner portion 42A and the fixed portion 44A, there are reinforcing ribs 443A arranged at intervals. The inner portion 42A is protruding to form a plurality of locking ribs 45A arranged at intervals. Each of the two adjustment holes 43A of the plate-shaped body 40A of the cord winding assembly 30A is pivotally mounted with one respective adjustment column 50A. Similarly, the plural stop ribs 53A of the adjustment column 50A radially surround the outer peripheral wall of the adjustment column 50A at intervals. In this way, the technical feature of pivotally mounting one respective adjustment column 50A to each of the two adjustment holes 43A of the plate-shaped body 40A of the cord winding assembly 30 can be used as a fine adjustment for multiple sets of lift cords 22.

Please refer to FIGS. 10 to 14, which provides still another cord winding assembly 30B suitable for the window blind 2. Its main structure and technical characteristics are the same as the previous preferred embodiment, that is, any cord winding assembly 30B comprises a plate-shaped body 40B and an adjustment column 50B pivoted on the plate-shaped body 40B. The difference between any cord winding assembly 30B and the previous preferred embodiment lies in: The plate-shaped body 40B of each cord winding assembly 30B comprises an outer portion 41B and an inner portion 42B opposite to the outer portion 41B. An adjustment hole 43B is formed through the outer portion 41B toward the inner portion 42B. The adjustment hole 43B near the opening of the outer portion 41B protrudes radially inward to form a ring-shaped shoulder 431B. The periphery of the adjustment hole 43B protrudes radially inward to form a plurality of barriers 433B arranged at intervals. The inner portion 42B protrudes to form a plate-shaped fixed portion 44B, and the fixed portion 44B is located at the lower edge of the adjustment hole 43B. The fixed portion 44B is penetrated with a perforation 441B, so that the opening direction of the fixed portion 44B's perforation 441B and the opening direction of the adjustment hole 43B are intersected. The two relatively short sides of the inner portion 42B respectively protrude to form a clamping portion 45B for clamping on the bottom rail 25, and the fixed portion 44B is interposed between the two clamping portions 45B. The adjustment column 50B of any of the cord winding assemblies 30B comprises a small diameter end 51B, a large diameter end 52B and multiple stop ribs 53B. The end of the large diameter end 52B of the adjustment column 50B is recessed to form an adjustment slot 54B. The end of the small diameter end 51B of the adjustment column 50B is pierced to form a perforation 55B. The opening direction of the perforation 55B of the small diameter end 51B of the adjustment column 50B is intersecting with the opening direction of the adjustment hole 43B of the plate-shaped body 40B and the opening direction of the fixed portion 44B of the perforation 441B. The plural stop ribs 53B of the adjustment column 50B radially surround the outer peripheral wall of the adjustment column 50B at intervals. The stop ribs 53B are closer to the large diameter end 52B, so that the predetermined distance between the large diameter end 52B and the stop ribs 53B is exactly greater than or equal to the overall thickness of the plate-shaped body 40B.

Next, please refer to FIGS. 10 to 14 together, and we will continue to disclose how to use the two cord winding assemblies 30B and cooperate with the overall window blind 2 to install on the opposite sides of the long axis of the bottom rail 25 of the window blind 2 and its intended effect.

Firstly, the two cord winding assemblies 30B are respectively installed on two opposite sides of the long axis of the bottom rail 25 and arranged opposite each other, so that the plate-shaped bodies 40B of the two cord winding assemblies 30B are stuck at the bottom of the bottom rail 25 by the clamping portions 45B. In this way, the clamping portions 45B of the plate-shaped bodies 40B of the cord winding assemblies 30B are clamped to the technical features of the bottom rail 25, so that any cord winding assembly 30B can no longer be easily disconnected from the bottom rail 25 of the window blind 2.

Figure 12:
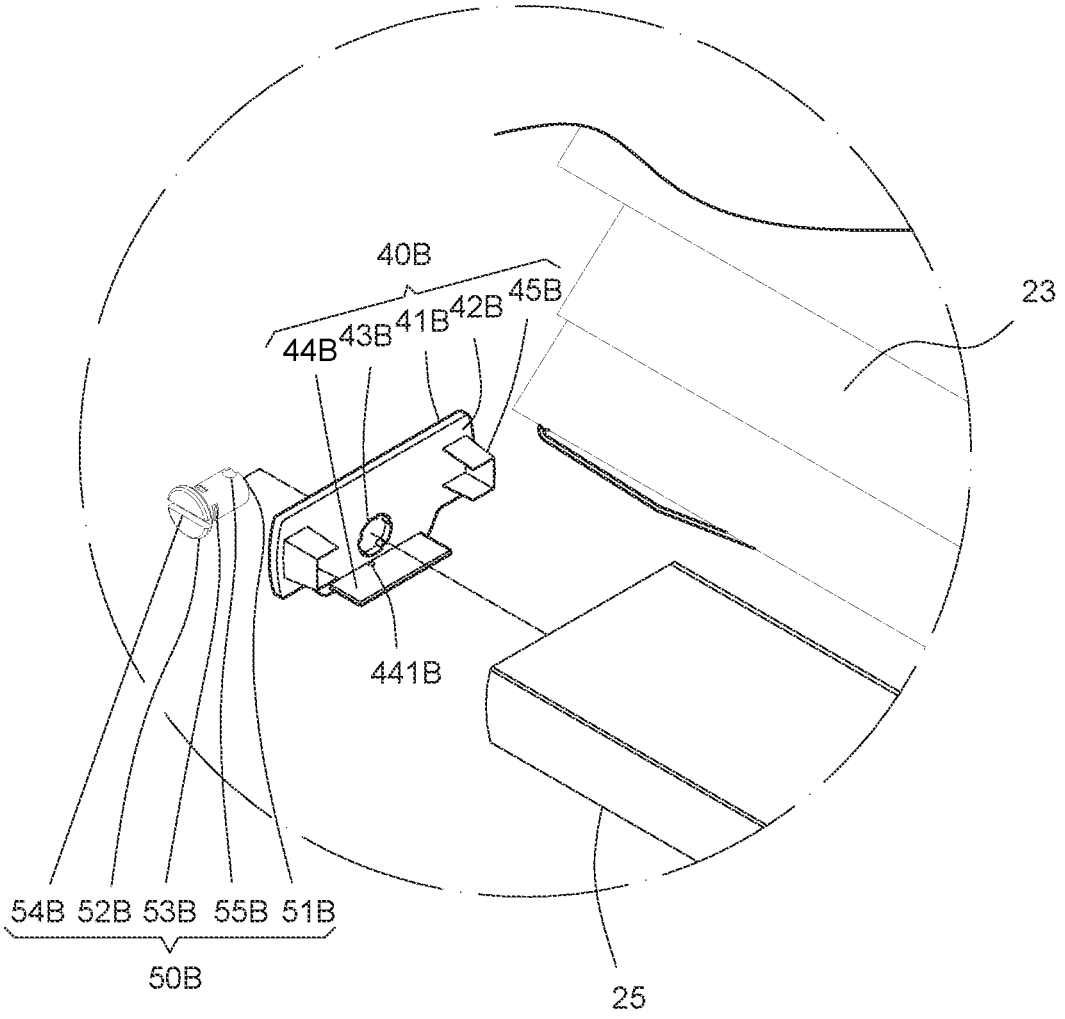
FIG. 12 is an exploded and enlarged schematic diagram of part of the components of FIG. 10, which mainly reveals the connection relationship between one cord winding assembly and the bottom rail of the window blind.
Figure 13:
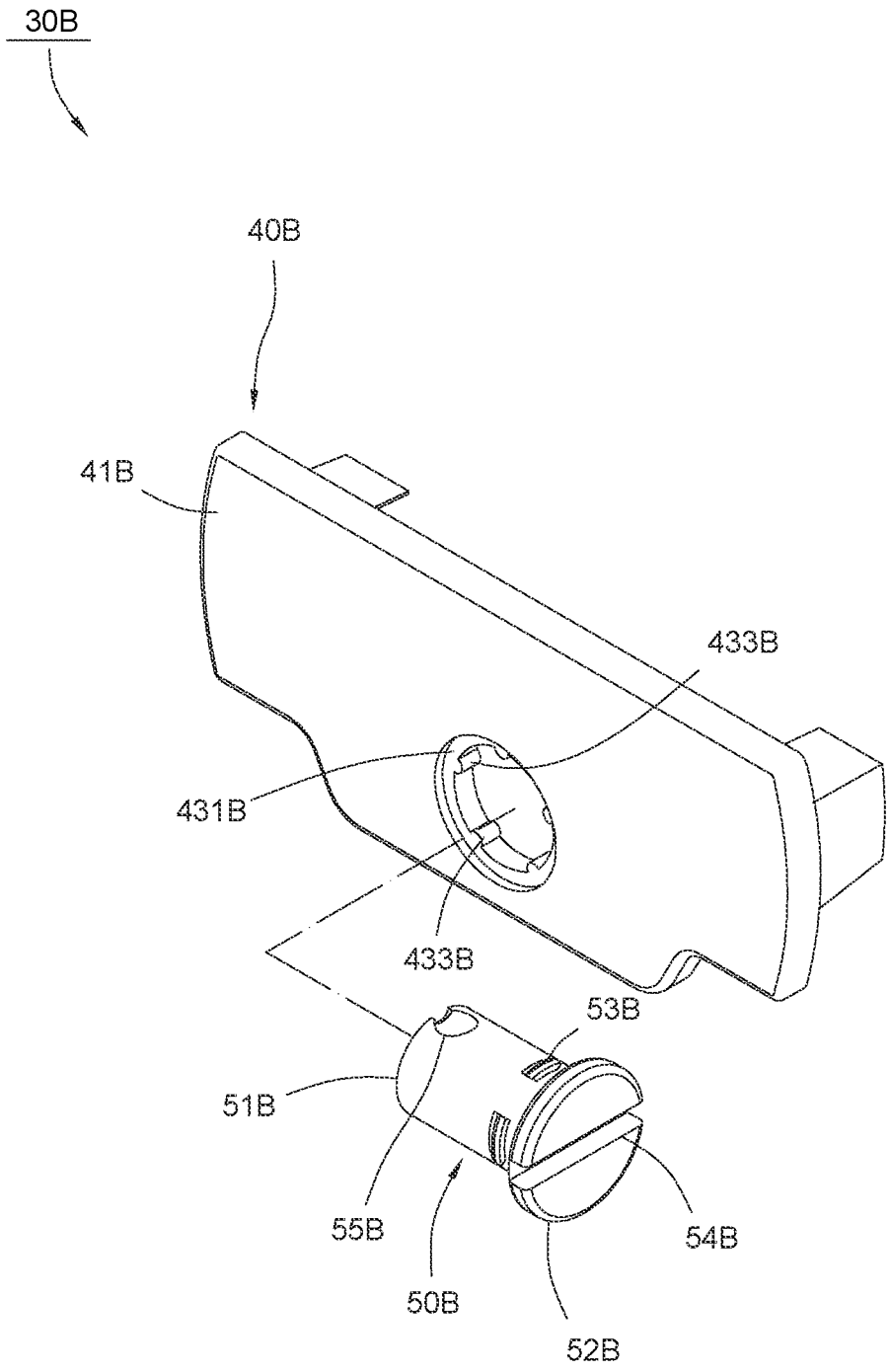
FIG. 13 is an enlarged schematic diagram of some components similar to FIG. 12, which mainly exposes the observation position of the cord winding assembly from another angle.
Figure 14:
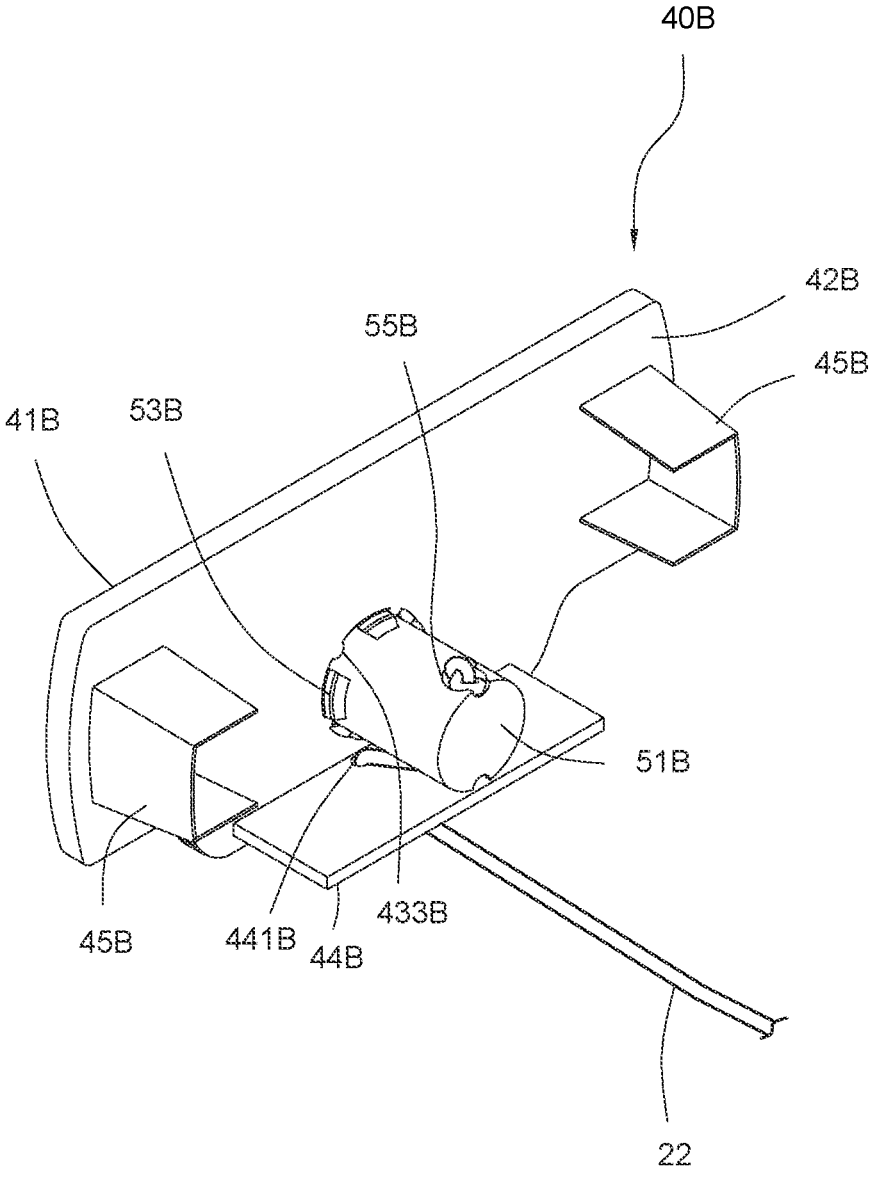
FIG. 14 is an enlarged schematic diagram of part of the components of FIG. 10, which mainly exposes the connection relationship between one cord winding assembly and the corresponding lift cord of the window blind.
Figure 15:
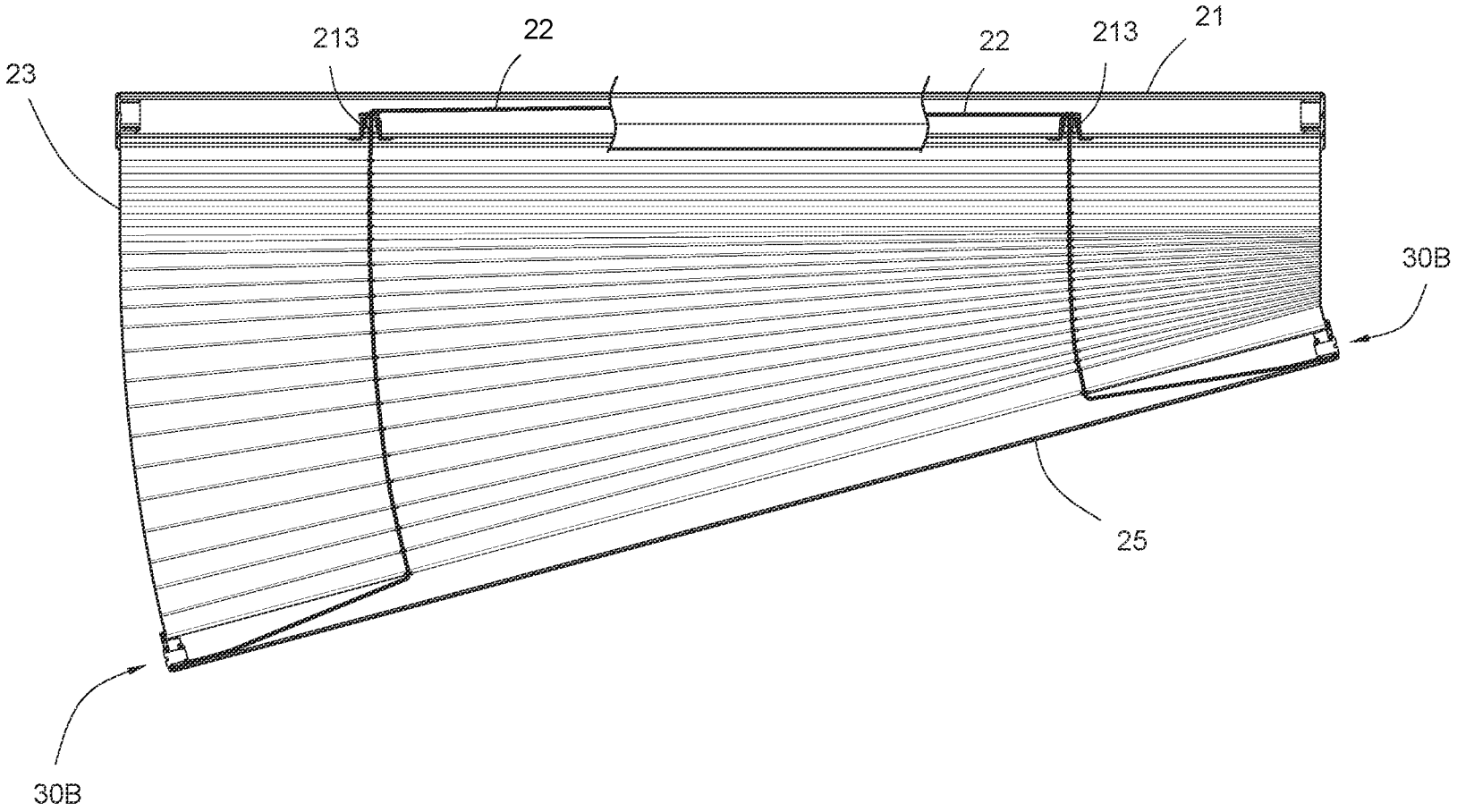
FIG. 15 is a schematic cross-sectional view of some components similar to FIG. 11, which mainly reveals that the window blind is in an unevenly folded state.
Figure 16:
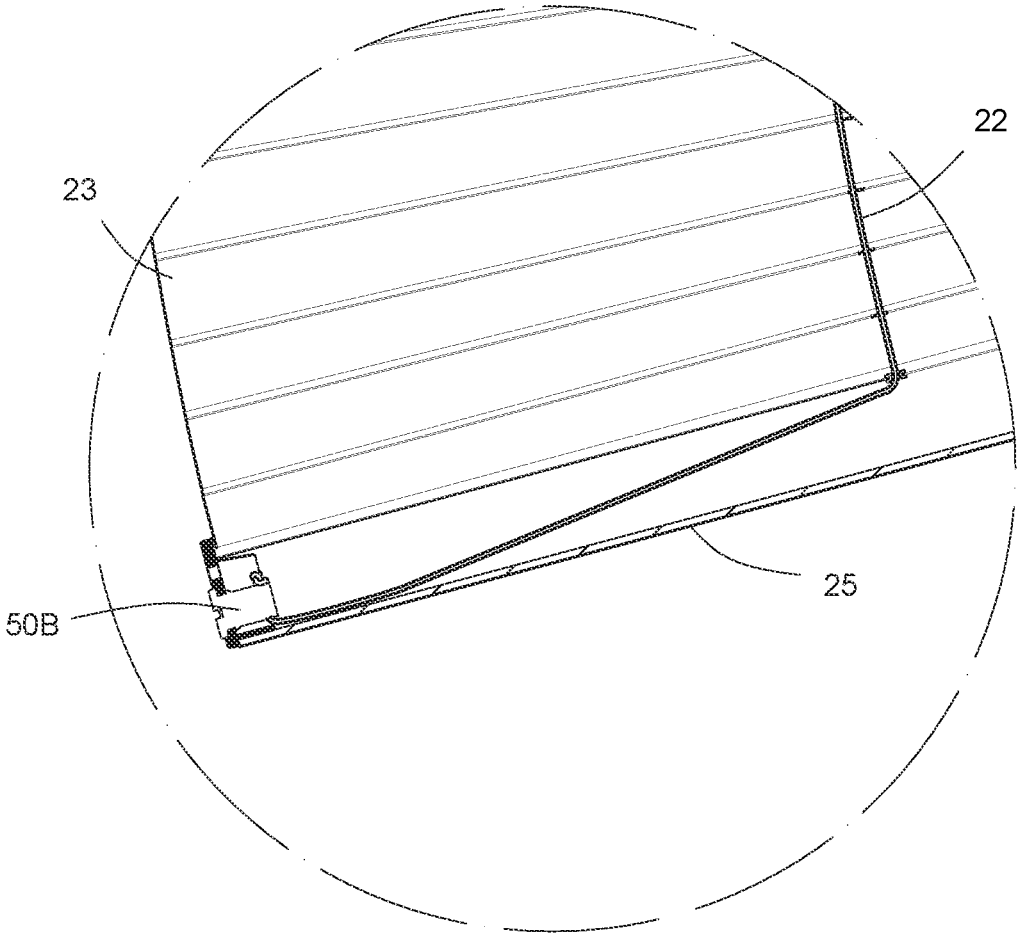
FIG. 16 is an enlarged schematic diagram of part of the components of FIG. 15, which mainly reveals the connection relationship between one cord winding assembly and the corresponding lift cord of the window blind that has not been fine-tuned.
Figure 17:
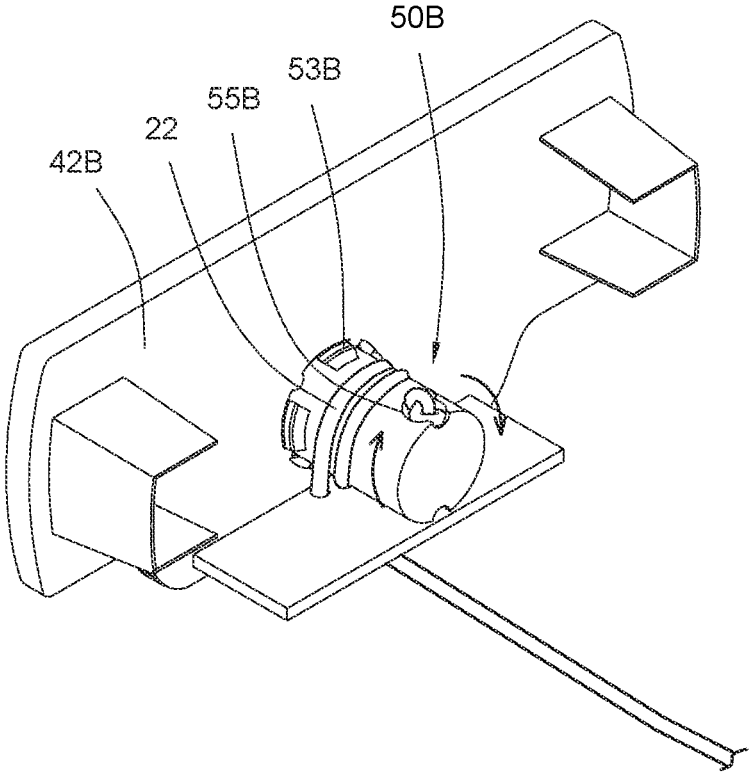
FIG. 17 is an enlarged schematic diagram of part of the components of FIG. 15, which mainly reveals the connection relationship between one cord winding assembly and the corresponding lift cord of the window blind being fine-tuned.

Secondly, please refer to FIG. 12 to FIG. 14. After the small diameter ends 51B of the adjustment columns 50B of the two cord winding assemblies 30B and the plural stop ribs 53B are respectively passed through the adjustment holes 43B of the two plate-shaped bodies 40B, the large diameter ends 52B of the two adjustment columns 50B are respectively restricted and blocked at the position of the ring-shaped shoulders 431B of the adjustment holes 43B of the two plate-shaped bodies 40B. At this time, the plural stop ribs 53B of each adjustment column 50B are also blocked on the inner portion 42B of the respective plate-shaped body 40B after passing through the adjustment hole 43B of the respective plate-shaped body 40B, so that the two adjustment columns SOB can be respectively movably pivoted at the adjustment holes 43B of the two plate-shaped bodies 40B. Preferably, after any of the adjustment columns 50B can be fixed in position by the barriers 433B of the adjustment hole 43B of the corresponding plate-shaped body 40B after it is pivoted clockwise or counterclockwise in the radial direction. In this way, with the technical characteristic that the large diameter end 52B and the plural stop ribs 53B of the adjustment column 50B of any cord winding assembly 30B are respectively stopped at the ring-shaped shoulder 431B of the adjustment hole 43B and the inner portion 42B of the plate-shaped body 40B, it achieves the effect that the adjustment columns 50B are no longer easily decoupled from the cord winding assemblies 30B.

Furthermore, please refer to FIG. 10 to FIG. 14 together. Let the other ends of the two lift cords 22 of the window blind 2 pass through the threading members 213 provided in the headrail 21, the blind body 23 and the bottom rail 25, and then pass through the perforations 441B of the fixed portions 44B of plate-shaped bodies 40B of 30B of the two cord winding assemblies 30B separately, and then let these other ends of the two lift cords 22 respectively pass through the perforations 55B of the small diameter ends 51B of the adjustment columns 50B and then be tied and fixed. In this way, with the technical feature that the opening direction of the perforation 441B of the fixed portion 44B of any plate-shaped body 40B is respectively intersected with the opening direction of the adjustment hole 43B, and the perforation 55B of the small diameter end 51B of the adjustment column 50B, the other end of the lift cord 22 is first passed through the perforation 441B of the fixed portion 44B of the plate-shaped body 40B, and then is tied and fixed at the perforation 55B of the small diameter end 51B of the adjustment column 50B. Then the other end of the lift cord 22 can no longer be easily disconnected from the adjustment column 50B of the cord winding assembly 30B. It also allows the adjustment column 50B of the cord winding assembly 30B and the winding device 211 of the headrail 21 to cleverly achieve the effect of mutual restraint through the two ends of the lift cord 22.

Finally, please refer to FIGS. 10 to 17 together. When the two lift cords 22 of the window blind 2 are folded or extended, unfortunately, the winding strokes of the two lift cords 22 are inconsistent, which indirectly causes the blind body 23 and the bottom rail 25 to no longer appear roughly parallel based on the bottom of the headrail 21, which in turn causes the blind body 23 to be unevenly folded or skewed. At this time, with the technical feature that the other ends of the two lift cords 22 are respectively tied to the adjustment columns 50B of the two cord winding assemblies 30B, you can select and fine-tune the adjustment column 50B of the cord winding assembly 30B on one side according to the situation, so that one of the lift cords 22 is gradually wound and covered on the adjustment column 50B, and indirectly drives the bottom rail 25 and the blind body 23 to gradually adjust to roughly parallel to the bottom of the headrail 21. Then the blind body 23 and the bottom rail 25 can be folded or stretched smoothly again. In this way, the blind body 23 will be able to effectively achieve the effect of fine-tuning, correcting and resetting. It is worth mentioning that an external hand tool can be inserted into the adjustment slot 54 of the adjustment column 50 of the cord winding assembly 30 to facilitate the application of clockwise or counterclockwise force to make the adjustment column 50 easier to pivot.

Figure 10:
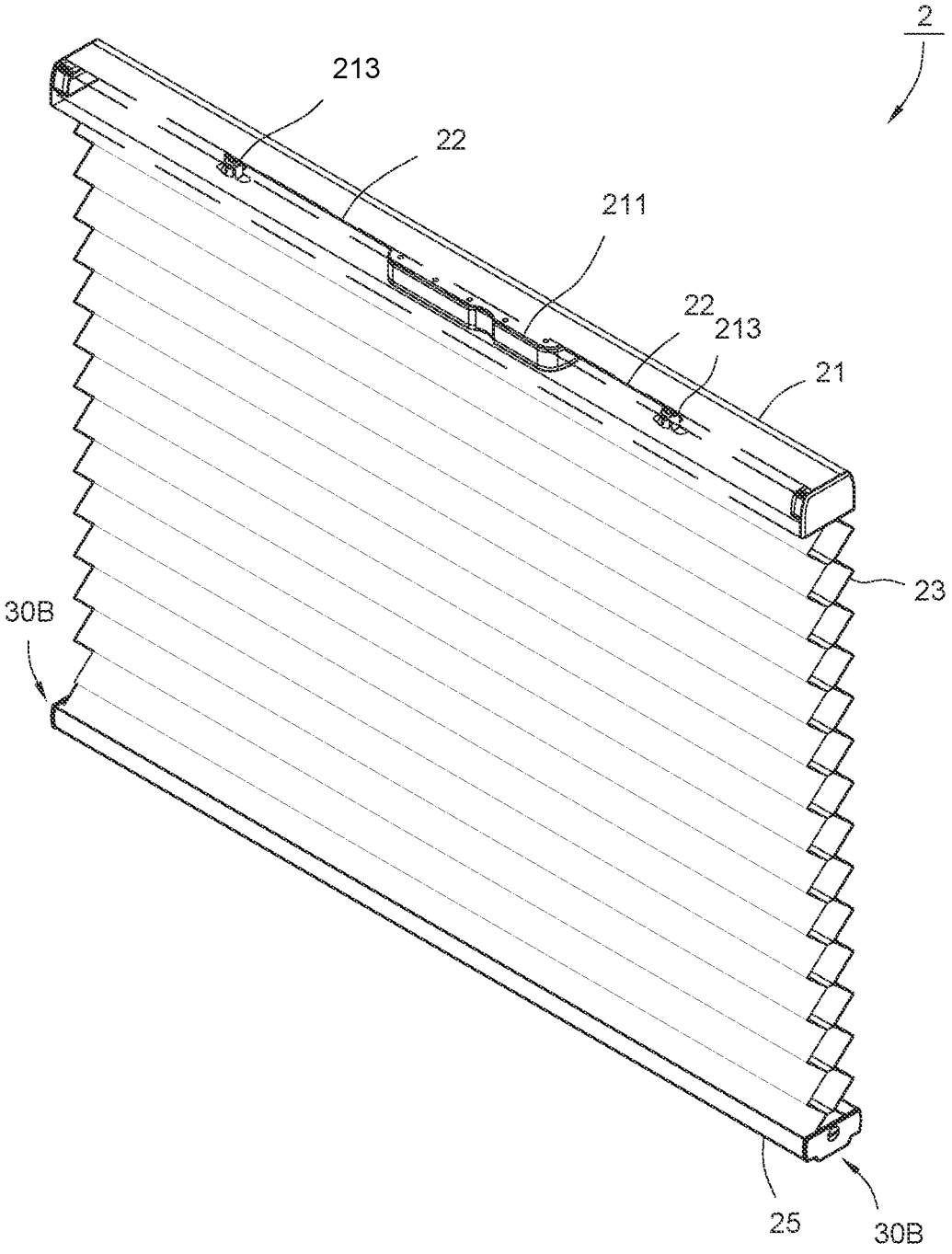
FIG. 10 is a three-dimensional schematic diagram of still another alternate form of cord winding assembly suitable for the window blind disclosed in the preferred embodiment of the present invention, which mainly reveals that the window blind presents a smoothly expanded state.
Figure 11:
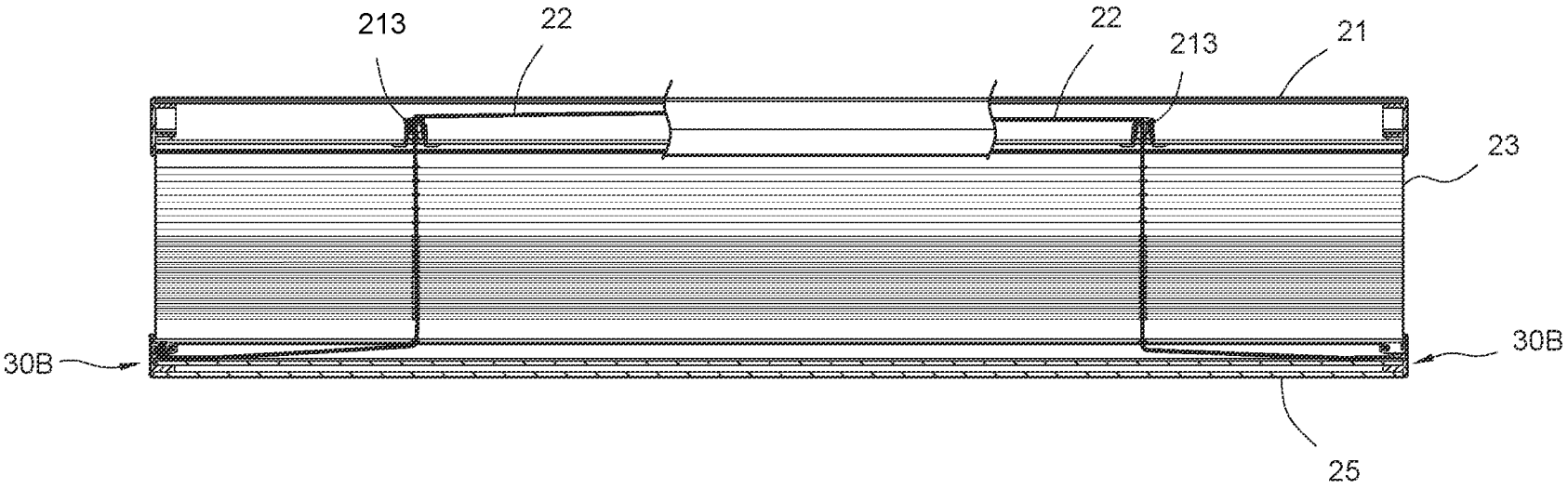
FIG. 11 is a schematic cross-sectional view of part of the components of FIG. 10, which mainly reveals that the window blind is in a smoothly folded state.
Figure 18:
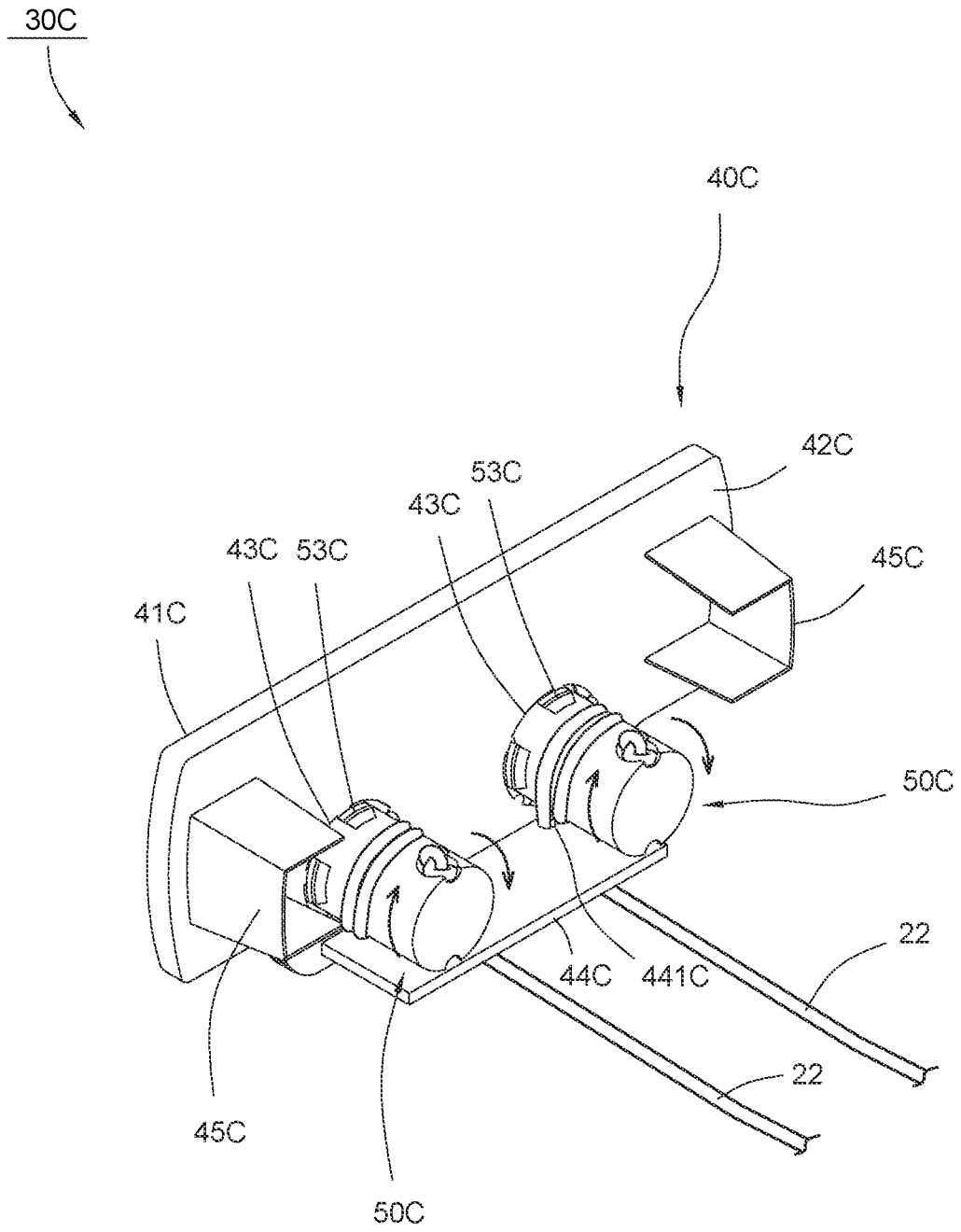
FIG. 18 illustrates still another alternate form of cord winding assembly suitable for the window blind disclosed in the preferred embodiment of the present invention, which mainly reveals the connection relationship between one cord winding assembly and the corresponding lift cord of the window blind that is being fine-tuned.

Please refer to FIG. 10 and FIG. 18, which provides still another cord winding assembly 30C suitable for the window blind 2. Its main structure and technical characteristics are the same as the previous preferred embodiment. The difference between any cord winding assembly 30C is outlined hereinafter. From the outer portion 41C of the plate-shaped body 40C of each cord winding assembly 30C toward the inner portion 42C, two adjustment holes 43C are formed. The inner portion 42C protrudes to form a fixed portion 44C and is located at the lower edge of the two adjustment holes 43C. The fixed portion 44C matches the positions of the two adjustment holes 43C to form two perforations 441C. Similarly, make the opening direction of the two perforations 441C of the fixed portion 44C cross the opening direction of the two adjustment holes 43C. Similarly, the two relatively short sides of the inner portion 42C respectively protrude to form a clamping portion 45C, which is used to be clamped on the bottom rail 25, and the fixed portion 44C is between the two clamping portions 45C. Each of the two adjustment holes 43C of the plate-shaped body 40C of each cord winding assembly 30C is pivotally mounted with an adjustment column 50C. In the same way, the plural stop ribs 53C of the adjustment column 50C are radially surrounding the outer peripheral wall of the adjustment column 50C at intervals. In this way, the technical feature of pivotally mounting one respective adjustment column 50C to each of the two adjustment holes 43C of the plate-shaped body 40C of the cord winding assembly 30C can be used as a fine adjustment for multiple sets of lift cords 22.

What is claimed is:

1. A cord winding assembly (30, 30A, 30B, 30C), comprising:

a plate-shaped body (40, 40A, 40B, 40C) comprising an outer portion (41, 41A, 41B, 41C), an inner portion (42, 42A, 42B, 42C) opposite to said outer portion (41, 41A, 41B, 41C) and an adjustment hole (43, 43A, 43B, 43C) penetrating said outer portion (41, 41A, 41B, 41C) and said inner portion (42, 42A, 42B, 42C), said inner portion (42, 42A, 42B, 42C) protruding to form a fixed portion (44, 44A, 44B, 44C), said fixed portion (44, 44A, 44B, 44C) having a perforation (441, 441A, 441B, 441C) cut therethrough; and an adjustment column (50, 50A, 50B, 50C) comprising a small diameter end (51, 51A, 51B, 51C) and a large diameter end (52, 52A, 52B, 52C), said large diameter end (52, 52A, 52B, 52C) having a distal end thereof recessed in the direction of said small diameter end (51, 51A, 51B, 51C) to form an adjustment slot (54, 54A, 54B, 54C), wherein said adjustment column (50, 50A, 50B, 50C) comprises a plurality of stop ribs (53, 53A, 53B, 53C), and said stop ribs (53, 53A, 53B, 53C) radially surrounding the outer peripheral wall of said adjustment column (50, 50A, 50B, 50C) at intervals, wherein said adjustment hole (43B, 43C) of said plate-shaped body (40B, 40C) near the opening of said outer portion (41B, 41C) protrudes radially inward to form a ring-shaped shoulder (431B, 431C); said adjustment column (50B, 50C) is pivoted at the position of said adjustment hole (43B, 43C) of said plate-shaped body (40B, 40C), and said large diameter end (52B, 52C) of said adjustment column (50B, 50C) is restricted to said ring-shaped shoulder (431B, 431C) of said adjustment hole (43B, 43C) of said plate-shaped body (40B, 40C), wherein the perimeter of said adjustment hole (43B, 43C) of said plate-shaped body (40B, 40C) protrudes radially inward to form a plurality of barriers (433B, 433C) arranged at intervals.

2. The cord winding assembly (30, 30A, 30B, 30C) as claimed in claim 1, wherein said stop ribs (53, 53A, 53B, 53C) are close to said large diameter end (52, 52A, 52B, 52C), so that the distance between said large diameter end (52, 52A, 52B, 52C) and said stop ribs (53, 53A, 53B, 53C) is greater than or equal to the thickness of said plate-shaped body (40, 40A, 40B, 40C).

3. The cord winding assembly (30B, 30C) as claimed in claim 2, wherein two relatively short sides of said inner portion (42B, 42C) of said plate-shaped body (40B, 40C) respectively protrude a clamping portion (45B, 45C), so that said fixed portion (44B, 44C) is between the two said clamping portions (45B, 45C).

4. The cord winding assembly (30B, 30C) as claimed in claim 1, wherein the opening direction of said perforation (441B, 441C) of said fixed portion (44B, 44C) of said plate-shaped body (40B, 40C) and the opening direction of said adjustment hole (43B, 43C) of said plate-shaped body (40B, 40C) are all crossed.

5. A window blind (2), comprising a headrail (21), two lift cords (22), a blind body (23), a bottom rail (25) and two cord winding assemblies (30B, 30C) as described in claim 4, wherein said two cord winding assemblies (30B, 30C) are respectively installed on two opposite sides of the long axis of said bottom rail (25); said blind body (23) has one side thereof set at a bottom of said headrail (21), and an opposite side thereof set at a top of said bottom rail (25); said two lift cords (22) have respective one ends thereof respectively tied to a winding device (211) provided in said headrail (21) after a predetermined stroke, and respective opposite ends thereof passed through a respective threading member (213) provided in said headrail (21), said blind body (23) and said bottom rail (25) and then respectively tied to said adjustment columns (50B,50C) of said cord winding assemblies (30B, 30C); said two lift cords (22) are driven by said winding device (211) of said headrail (21) to perform winding or unwinding.

6. The window blind (2) as claimed in claim 5, wherein said small diameter end (51B, 51C) of said adjustment column (50B, 50C) of each said cord winding assembly (30B, 30C) has a perforation (55B); after the said opposite ends of said two lift cords (22) are passed through said two threading members (213) of said headrail (21), said blind body (23), said bottom rail (25) and said perforations (441B, 441C) of said fixed portion (44B, 44C) of said plate-shaped bodies (40B, 40C) of said two cord winding assemblies (30B, 30C), the said opposite ends of said two lift cords (22) are respectively tied and fixed by passing through said perforations (55B) of said small diameter ends (51B, 51C) of said two adjustment columns (50B, 50C).

7. The window blind (2) as claimed in claim 6, wherein the opening direction of said perforation (55B) of said small diameter end (51B, 51C) of said adjustment column (50B, 50C) of each said cord winding assembly (30B, 30C) and the opening direction of said adjustment hole (43B, 43C) of said plate-shaped body (40B, 40C) and the opening direction of said perforation (441B, 441C) of said fixed portion (44B, 44C) are all crossed.

* * * * *